United States Patent [19]

Dolenga et al.

[11] 4,005,324

[45] Jan. 25, 1977

[54] TUNGSTEN-FLUORINE LAMP WITH NATIVE RETAINED OXYGEN THEREIN AND METHOD OF MANUFACTURE

[75] Inventors: Arthur Dolenga, Sterling Heights; John C. Hill, Bloomfield Hills, both of Mich.

[73] Assignee: General Motors Corporation, Detroit, Mich.

[22] Filed: Mar. 17, 1976

[21] Appl. No.: 667,616

[52] U.S. Cl. ..... 313/222; 316/20

[51] Int. Cl.[2] ..... H01J 9/395; H01K 1/50

[58] Field of Search ..... 313/222; 316/20

[56] References Cited

UNITED STATES PATENTS

| | | | |
|---|---|---|---|
| 3,619,701 | 11/1971 | Sugano et al. | 313/222 |
| 3,783,328 | 1/1974 | Neumann | 313/222 |

*Primary Examiner*—Palmer C. Demeo
*Attorney, Agent, or Firm*—J. C. Evans

[57] ABSTRACT

A tungsten fluorine lamp is manufactured by a process including the steps of forming a glass bulb and tungsten filament-lead set to have a controlled content of native oxygen thereon; locating and sealing the tungsten filament and lead set in the bulb and thereafter by a simplified three-step process of evacuation, gas fill and bulb tubulation tip seal step forming a completed lamp assembly; and wherein the completed lamp assembly includes a gas fill comprising an inert component at six atmospheres and a fluorinated hydrocarbon component of only carbon, bromine and fluorine with a range of $3.2 \times 10^{-7}$ to $8 \times 10^{-7}$ gram atoms of carbon, $2.1 \times 10^{-6}$ to $5.2 \times 10^{-6}$ gram atoms of bromine, and $1.5 \times 10^{-6}$ to $3.8 \times 10^{-6}$ gram atoms of fluorine and an oxygen content (evolved from the aforesaid native oxygen) of $1.3 \times 10^{-6}$ to $3.3 \times 10^{-6}$ gram atoms (all per cc of lamp assembly gas volume) thereby to produce a controlled equimolar relationship of fluorine and oxygen for stable tungsten fluorine oxygen cycle operation.

2 Claims, 8 Drawing Figures

TUNGSTEN-FLUORINE LAMP WITH NATIVE RETAINED OXYGEN THEREIN AND METHOD OF MANUFACTURE

It is known that tungsten halogen lamp assemblies of the type including bulb components having interior wall surfaces, tungsten filaments and lead sets therein all have contaminants thereon that can interfere with known regenerative cycles in which tungsten vapor from the filament combines with halogen fill gas constituents and is redeposited on the filament to prevent excessive filament erosion. As a result, in the processing of tungsten halogen lamp assemblies various techniques have been utilized to eliminate the contaminants from within the bulb. One approach has been to flash the bulb filament in the presence of a forming gas such as a mixture of 85% nitrogen and 15% hydrogen as well as to heat the interior walls of the evacuated bulb during filament flashing to prevent absorption or adsorption of expelled contaminants from other component parts of the lamp assembly. An example of such a process is set forth in U.S. Pat. No. 3,901,573 issued Aug. 26, 1975, to Arthur Dolenga and John C. Hill. Other examples of tungsten halogen bulb processing methods for removing such contaminants are set forth in U.S. Pat. No. 3,788,725 issued Jan. 29,1974 to Yannopoulos et al. and U.S. Pat. No. 3,160,454 issued Dec. 8, 1964, to Zubler et al.

More recently, in U.S. Pat. No 3,783,328 issued Jan. 1, 1974, to Neumann maintenance of a tungsten halogen cycle has been proposed wherein equimolar amounts of both fluorine and oxygen are present to prevent attack of the fluorine on the cooler parts of the bulb filament. However, the process suggested in the Neumann patent requires separate handling of both oxygen and corrosive fluorine with attendant problems of attack and corrosion of production equipment as well as the need to inject two separate gas components along with the inert gas constituents during the final fill gas phase of operation. Accordingly, the addition of free fluorine to the usual inert fill gas such as nitrogen, argon or krypton is not entirely satisfactory. It is preferable to use a fluorine compound which is stable and easily handled at normal temperatures, but which will decompose to liberate fluorine at the higher temperatures in the lamp. An example of such a fill gas constituent is set forth in U.S. Pat. No. 3,732,455 issued May 8, 1973 to Neumann. This patent suggests the use of fluorine compounds which are stable and easily handled at normal temperatures. However, they enumerate a selected range of fluorine from $1 \times 10^{-8}$ to $1 \times 10^{-6}$ gram atoms per cc of bulb volume without statement as to the desired oxygen content for maintenance of the tungsten fluorine regenerative cycle. However, the gas constituents of the U.S. Pat. No. 3,732,455 Neumann bulb preclude presence of retained native oxygen on the bulb components in excess of $1 \times 10^{-6}$ gram atoms of or in the range of $1.3 \times 10^{-6}$ to $3.3 \times 10^{-6}$ gram atoms per cc of bulb volume since excessive oxygen produced by such retained native oxygen components will result in an undesirable tungsten-fluorine cycle as reported by Neumann in Zeitschrift for Metall Kunde, Volume 64, page 26 (1973).

The present invention is directed to an improved tungsten-fluorine lamp and its process of manufacture which recognizes the need to maintain fluorine and oxygen of a tungsten fluorine lamp in balance and to do so by processing steps which materially simplify lamp fabrication. As noted above, several of the normal manufacturing steps heretofore utilized in tungsten halogen bulbs are designed to eliminate impurities including oxygen. Or, in the alternative, where it is recognized it is necessary to keep the fluorine and oxygen in balance it is proposed to utilize free fluorine and inject it and molecular oxygen as separate fill gas constituents during the fill gas phase of lamp manufacture.

The present invention includes a fluorine compound constituent which is stable and easily handled at normal temperatures and which will decompose to liberate fluorine at the higher operating temperatures of the lamp. The fluorine compound consists only of carbon, bromine and fluorine, of carbon $3.2 \times 10^{-7}$ to $8 \times 10^{-7}$ gram atoms, bromine $2.1 \times 10^{-6}$ to $5.2 \times 10^{-6}$ gram atoms and fluorine $1.5 \times 10^{-6}$ to $3.8 \times 10^{-6}$ gram atoms (all per cc of bulb volume). The specific fluorine compound is bromotrifluoromethane ($CBrF_3$) and the specific range is selected to combine with native oxygen retained on lamp bulb walls and filament during lamp manufacture thereby to eliminate the need for manufacturing steps heretofore utilized to eliminate impurities including oxygen from within the bulb. For example, the present invention eliminates steps of heating a filament to incandescense in the presence of a forming gas to reduce tungsten oxides from the filaments and to heat the glass envelope while under vacuum to drive out hydroxyl radicals thereby to prevent both $H_2O$ and oxygen contamination. To accomplish this purpose, the tungsten fluorine lamp of the present invention utilizes a specific fluorine compound having only carbon, bromine and fluorine in the range as set forth above and further includes a controlled native oxygen on the lamp bulb wall and tungsten filament releasable upon bulb operation to form an additional fill gas constituent of molecular oxygen in the range of $1.3 \times 10^{-6}$ to $3.3 \times 10^{-6}$ gram atoms per cubic centimeter of bulb volume to balance a gram atom constituent of the fill gas in the form of fluorine which is released from the stable fluorine compound during bulb operation.

The improved method in accordance with the present invention includes the steps of preforming a tungsten filament of lamp grade tungsten in a lead set; forming a glass envelope having a tubulation on one end thereof and an open end on the opposite end thereof, locating the current lead and filament through the open end of the envelope on a lead set mount having a tapered surface thereon facing the open end of the envelope; directing a cover gas through the envelope from the tubulation thereon through the open end thereof and across the tapered surface of the lead set mount to maintain a smooth gas flow across the lead set, thereafter heating and hermetically press sealing the envelope against the current leads to produce a hermetic seal of the envelope with respect to the lead set and retaining a quantity of native oxygen on the filament and bulb walls releasable upon bulb operation to add a fill gas constituent of oxygen in the range of $1.3 \times 10^{-6}$ to $3.3 \times 10^{-6}$ gram atoms per cubic centimeter of the final lamp bulb volume; thereafter evacuating the bulb to $10^{-5}$ torr with a mechanical pump and liquid $N_2$ trap; then filling with krypton of 99.995% purity and with a concentration of $CBrF_3$ as stated above; and thereafter sealing the tubulation while the lamp bulb is immersed in liquid $N_2$ so as to condense a controlled amount of fill gas therein to produce a sealed off lamp pressure of 6 atmospheres at room temperature.

Further objects and advantages of the present invention will be apparent from the following description, reference being had to the accompanying drawings wherein a preferred embodiment of the present invention is clearly shown.

Figure 1:
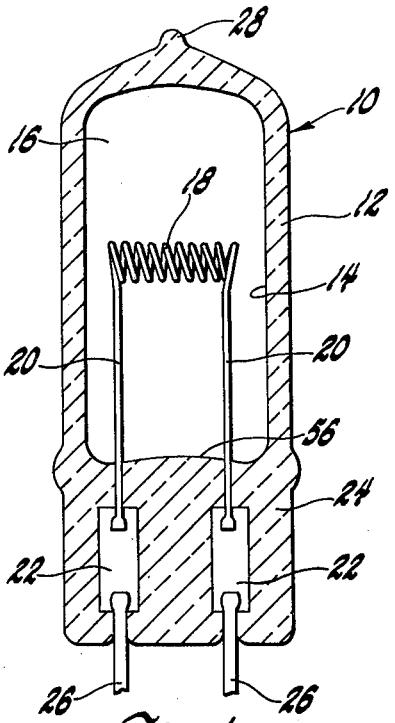
FIG. 1 is an elevational view of a tungsten-fluorine bulb of the present invention.

Referring to the drawing, in FIG. 1 a tungsten fluorine compound lamp assembly 10 is illustrated including a glass envelope 12 having an interior bulb wall 14 defining a generally cylindrical bulb cavity 16. A coiled tungsten filament 18 has a pair of downwardly depending, spaced-apart legs 20 attached to foils 22 hermetically sealed within a flat base 24 of the lamp assembly 10. A pair of terminal wires 26 attached to the lower end of each of the foils 22 extend from the base 24 and are adapted to be connected to a suitable power source for energizing the filament 18 during lamp operation.

The envelope 12 is formed of a high melting point glass having a hydroxyl content in the order of 100 ppm. A suitable material for the envelope is manufactured by Corning Glass Company under the trade name Vycor and available as product code No. 7913. Other glass envelope materials are equally suited for practicing the present invention. The envelope 12 has a heat-sealed tip 28 on the upper end thereof representing a tipped off segment of an envelope tubulation to be described.

In accordance with certain principles of the present invention, the bulb wall 14 and tungsten filament 18 have a controlled content of native oxygen retained thereon during bulb manufacture. It is releasable upon bulb operation to produce a gas fill content of oxygen in the range of $1.3 \times 10^{-6}$ to $3.3 \times 10^{-6}$ gram atoms per cc of bulb volume. Additionally, the lamp 10 has a further gas fill constituent including an inert gas, for example, krypton of 99.995% purity. Other inert gases such as nitrogen, argon or mixtures of nitrogen, argon and krypton are equally suited for use in the present invention. The bulb fill gas is at a pressure of 6 atmospheres within the cavity 16 under room temperature conditions. Additionally, the cavity 16 includes a further gas fill constituent in the form of a gaseous fluorinated hydrocarbon containing only carbon, bromine and fluorine. A specific example of such gas is bromotrifluoromethane ($CBrF_3$). However, other fluorinated hydrocarbons containing only carbon; bromine and fluorine are also suitable for use in the present invention. The gaseous fluorinated carbon, furthermore, in practicing the present invention has the following specific formulation including a range of $3.2 \times 10^{-7}$ to $8 \times 10^{-7}$ gram atoms of carbon, $2.1 \times 10^{-6}$ to $5.2 \times 10^{-6}$ gram atoms of bromine and $1.5 \times 10^{-6}$ to $3.8 \times 10^{-6}$ gram atoms of fluorine (all per cc of bulb volume).

A tungsten fluorine lamp assembly with the aforesaid gas constituents has the advantage of eliminating the need for extreme care in removing contaminants from the inner bulb wall 14 and the filament 18 as more specifically set forth in our U.S. Pat. No. 3,901,573 issued Aug. 26, 1975, for a method of processing tungsten-halogen lamps. The retention of native oxygen in the quantities as set forth above eliminates the need for tungsten halogen processing steps heretofore required for maintenance of extreme bulb cleanliness to assure reliable tungsten halogen regeneration cycles of operation. More specifically, the retention of the aforesaid native oxygen eliminates the need for processing steps, including flashing of a filament, bulb heating and the direction of flushing gas through the bulb cavity during the processing steps.

When the above-described bulb is connected to a suitable source of power, the filament 18 is energized and the bulb walls are heated to an elevated temperature in excess of 250° C. Operation of the filament at this temperature expels native oxygen from both the filament 18 and the interior walls 14 of the lamp 10 into the cavity 16 for cooperation with the constituent parts of the fluroinated hydrocarbon set forth above thereby to produce a stable tungsten-fluorine-oxygen cycle with a resultant prevention of filament erosion during bulb operation.

By virtue of the aforedescribed fill gas and presence of releasable native oxygen on the tungsten filament 18 and bulb walls 14 there is no observable attack of the lamp walls or the filament legs throughout the operating life of the lamp assembly for $CBrF_3$ concentrations up to 250 ppm. This is in part due to the equimolar relationship of the released fluorine constituent and the released native oxygen that combine to produce a stable tungsten fluorine cycle. While the total effect of the released native oxygen from the tungsten filament and bulb walls 14 in conjunction with the specifically enumerated range of only fluorine, bromine and chlorine in the fluorinated hydrocarbon fill gas constituent is not entirely understood at present, it appears the fluorinated hydrocarbon forms carbon-tetrafluoride at the cool parts of the cavity adjacent to the bulb wall 14 as well as hydrogen-bromide, carbon monoxide and various tungsten-oxyfluorides. The latter, in particular, decompose only at the hottest part of the filament. These parts are typically areas from which the greatest amount of tungsten is evaporated which result in a reduced cross sectional area having increased resistance and therefore greater temperature.

The released native oxygen gas constituent simplifies bulb fabrication and the selection of a fluorinated hydrocarbon gas containing only carbon, bromine and fluorine in the range set forth above will have the effect of returning the tungsten to the area of greatest tungsten evaporation during bulb operation. In effect, this provides a selective reconstruction of the filament. It produces an increased bulb life indicated by the following examples: test bulbs with 250 ppm $CBrF_3$ had an average life of 170 hours and test bulbs with 100 ppm $CBrF_3$ had an average life of 350 hours, in comparison with conventional halogenated hydrocarbon bulbs having lives of around 140 hours. This improved life characteristic is obtained with bulb and filament components that use low cost hydroxyl content bulb material as well as filament and lead set components having retained residual contaminants in the form of native oxygen to eliminate processing operations which are otherwise required in tungsten halogen bulb manufacture.

Figure 3:
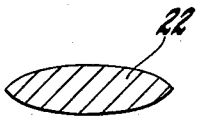
FIG. 3 is an enlarged cross-sectional view taken along the line 3—3 of FIG. 2.
Figure 2:
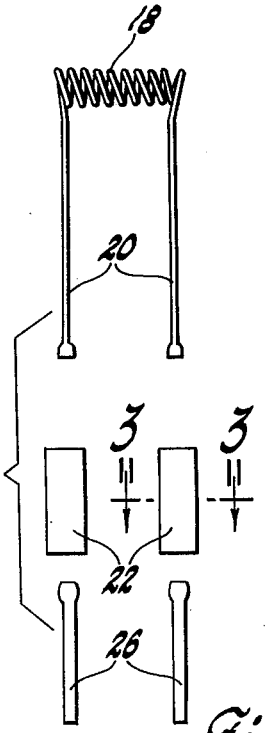
FIG. 2 is an exploded view of a filament lead set used in the bulb of FIG. 1.

Referring now to FIGS. 2 through 8, a simplified method of processing tungsten fluorine bulbs having the aforesaid improved operational life characteristics is set forth. As shown in FIG. 2, a tungsten filament 18 is made from lamp grade tungsten, for example, process 218 CS tungsten available from General Electric Company and designed to consume 55 watts at 12 volts connected across the filament leg portion thereof. As shown in FIG. 3, the foils 22 have a lenticular shape which facilitates formation of a hermetic seal with a glass envelope as will be discussed. The ends of the legs 20, as shown in FIG. 2, are located on one side of each of the foils 22. The foils 22 are of molybdenum with platinum plated tabs at the point of connection between the ends of the legs 20 and the foils 22. The platinum plated tabs act as flux agents when welding the foils 22 to the filament. Likewise, the current leads or terminal wires 26 have their ends connected to the same surface of each of the foils 22 and include a platinum plated tab portion thereon also to act as a flux agent when the terminal wires 26 are welded to the foils 22. The assembled tungsten filament 18, foils 22 and terminal wires 26 form a completed filament and lead set 30. In one example of the process, the lead sets are fired in a stream of dry hydrogen (with a flow rate greater than one cubic meter per hour) at 1100° C for about 20 minutes.

Figure 4:
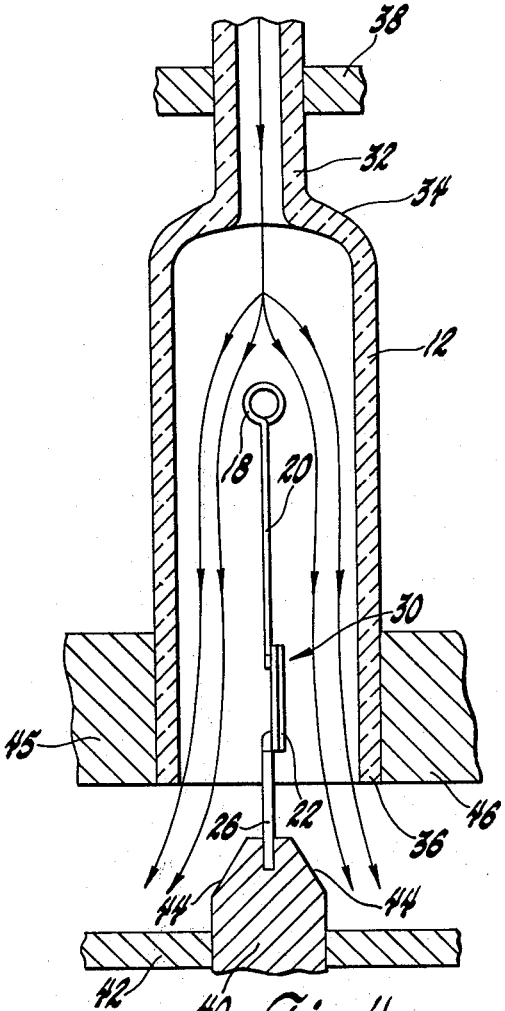
FIG. 4 is a view in cross-section of a lamp envelope; filament lead set and lead set mount utilized in the method of the present invention.

As best shown in FIG. 4, a glass envelope made from either Vycor or fused quartz is preformed to have a ten mm outside diameter and a one mm wall thickness. The glass envelope includes a four mm outside diameter tubulation 32 on the top 34 thereof and includes an opposite open end 36 thereof. In one example, the preformed glass envelope was rinsed in an Alconox solution followed by two rinses in distilled water and was air dried. The preprocessing of both the glass envelope and the filament lead set 30 are merely representative examples of processes that clean unusually contaminated components. These steps can be omitted when commercially available filament and glass envelope components are selected for practicing the present invention, these commercially available filament and lead set components have retained native oxygen thereon in quantities sufficient to meet the final oxygen content requirement set forth with respect to the completed bulb assembly in FIG. 1.

Figure 5:
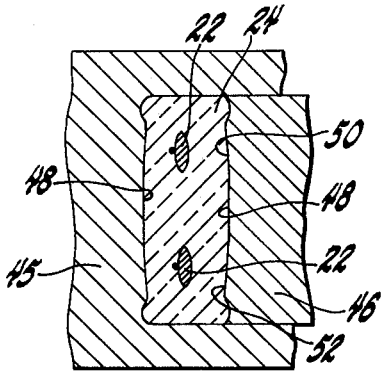
FIG. 5 is a view in cross section of the bulb envelope and a die set used to seal current leads with respect to the bulb envelope in the present invention.

It is recognized that a tungsten halogen cycle can be disrupted by entrance of impurities into a sealed bulb. Accordingly, one step of the present invention is to assure the formation of a vacuum type press seal between the glass envelope 12 and the lead set 30. To accomplish this purpose as best seen in FIG. 4, the tubulation 32 is clamped in an upper fixture 38 and a lead set mount 40 is clamped in a lower fixture 42 to align the filament and lead set 30 axially upwardly within the open end 36 of the envelope 12 in the position shown in FIG. 4. At this point, the foils 22 are located axially inwardly of the open end 36 and the current leads 26 extend axially outwardly thereof and the tungsten filament is supported generally midway within the envelope 12. In practicing the invention a protective flow or cover of forming gas (85% nitrogen and 15% hydrogen) is directed through the tubulation 32 and outwardly of the open end 36 of the envelope 12. The lead set mount 40 has a tapered weld pocket surface 44 thereon to assure maintenance of a smooth gas flow from the open end 36 thereby to prevent back flow of air into the interior of the envelope 12 at this stage of the process. The method further includes location of a pair of spaced apart dies 45, 46 on the outside surface of the envelope 12 immediately above the open end 36 at a point transversely of the location of the foils 22. The dies have a cross section as shown in FIG. 5 and each includes a center flat 48 thereon from which side inclined surfaces 50, 52 are directed to form a cross sectional open area between the dies when they are closed against one another which is approximately 90% of the cross sectional area of the walls of the envelope. This configuration is required to assure complete flow of the walls of the envelope around the foils 22 when the dies 45, 46 are hydraulically driven towards one another during a press seal step wherein the envelope 12 is heated at the end 36 by means such as a torch to soften the glass for die extrusion. The configuration of the dies will produce some extrusion of the soft glass beyond the ends of the dies when the flat base 24 is formed.

Figure 6:
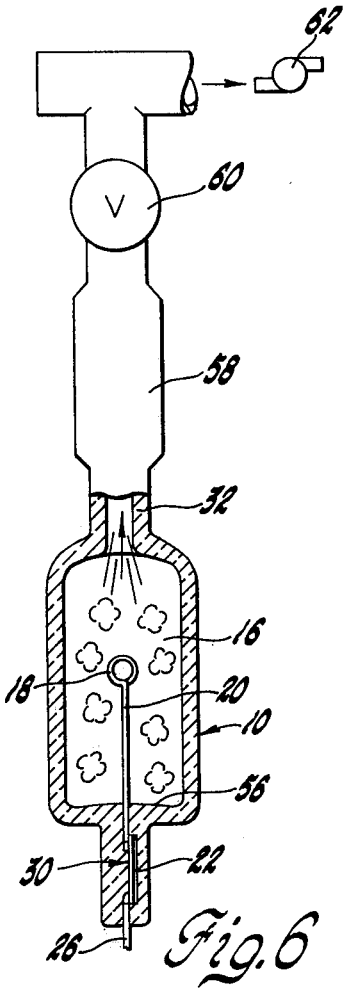
FIG. 6 is a view in cross section of the bulb following press-sealing of the current lead therein at a bulb evacuation step of the present invention.

As shown in FIG. 6, it is important to provide an extrusion wherein the walls of the envelope at the open end will be deformed inwardly along a curvature as shown at 56 when the walls are joined together and extruded around the foils 22 in hermetically sealed relationship therewith.

The aforesaid steps of filament lead set alignment and hermetic sealing of the set to one end of a glass envelope are characterized as maintaining a retained quantity of native oxygen on the filament 18 and the inner wall 14 of the glass envelope 12 in a controlled quantity which is releasable following lamp fabrication and during operation of the lamp to produce a fill gas constituent of free oxygen in the range of $1.3 \times 10^{-6}$ to $3.3 \times 10^{-6}$ gram atoms per cubic centimeter of the aforesaid cavity volume.

This characteristic of the aforesaid processing step is in contrast to normal tungsten halogen bulb manufacture with processing sequences including filament energization and passage of flushing gas across the flashing filament and heated walls to remove native oxygen from the component parts of the lamp rather than retaining elevated quantities of native oxygen as set forth above. The retention of native oxygen as set forth above eliminates several processing steps in the manufacture of a tungsten halogen bulb resulting in simplification of the manufacturing process.

Following the process to produce a desired retained native oxygen content on the component parts of the bulb the bulbs are subjected to a simple three step process sequence including (FIG. 6) flow of gas from the bulb cavity 16 through the tubulation 32 thence across a controlled volume 58 and an open valve 60 to the inlet of a vacuum source 62. In one working process, the lamp cavity 16 is evacuated to $10^{-5}$ torr by means of a mechanical pump and a liquid $N_2$ trap.

Figure 7:
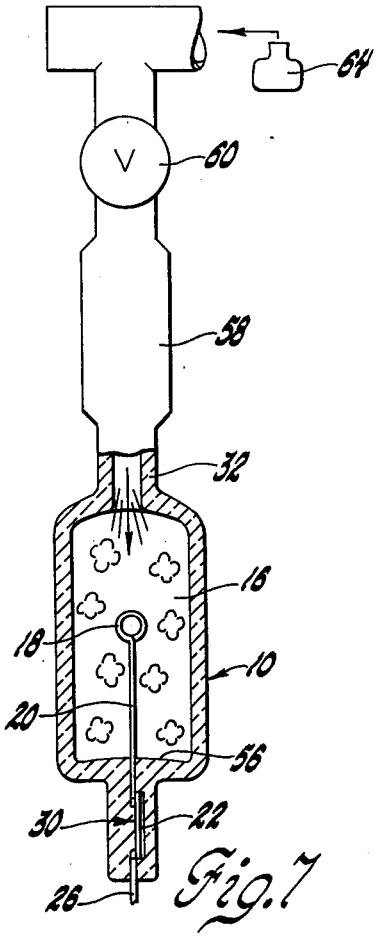
FIG. 7 is a view in cross section of the bulb in FIGS. 3 through 5 during a gas fill step of the present invention.
Figure 8:
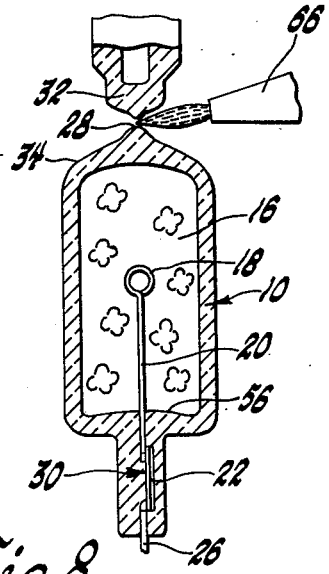
FIG. 8 is a view in vertical section of the bulb during a tubulation tip off step of the present invention.

Thereafter, as shown in FIG. 7, a fill gas of krypton of 99.995% purity and with a fluorinated hydrocarbon of only carbon, bromine and fluorine having the concentration range set forth above is directed into the evacuated cavity 16. First valve 60 is closed and the vacuum source 62 is disconnected. Then a fill gas source 64 is connected and valve 60 is opened to direct the fill gas composition into volume 58. The bulb is immersed in liquid nitrogen to condense a controlled amount of the fill gas within the cavity 16. The final process step (FIG. 8) includes tipping off the tubulation 32 by means of a torch 66 applied to the cross section of the tubulation 32 immediately above the top 34 to produce the sealed tip 28 of the final lamp assembly 10. At this final step the lamp gas pressure (at room temperature) is typically 6 atmospheres.

Thus, by practicing the invention an improved tungsten flourine cycle is maintained in a tungsten halogen lamp including a tungsten fluorine oxygen cycle having a fluorine oxygen ratio of approximately 1:1 to maintain a desired regenerative cycle. The oxygen requirements of the cycle are supplied simply by eliminating certain processing steps normally designed to remove contaminants such as oxygen from the bulb prior to a fill phase of operation. The residual oxygen in the resultant bulb is balanced by adding a fill gas constituent of a stable fluorine compound in the form of bromotrifluoromethane in a range with fluorine in excess of amounts heretofore suggested. The thermal stability of selected fluorohydrocarbons prevents undesirable attacks of the bulb components and furthermore eliminates the need to handle free oxygen and fluorine in manufacturing processes or to inject these components following bulb preparation. In addition to providing improved life, the aforesaid fluorine cycle lamps as processed by the present invention are less expensive to produce by virtue of the reduced number of processing steps which are otherwise required in fabricating a tungsten halogen incandescent lamp. Lamp life is more than twice that of lamps containing bromine alone.

While the embodiments of the present invention, as herein disclosed, constitute a preferred form, it is to be understood that other forms might be adopted.

The embodiments of the invention in which an exclusive property or privilege is claimed are defined as follows:

1. A tungsten halogen lamp comprising a glass bulb having walls defining a sealed cavity, a tungsten filament within said bulb having spaced apart legs, a filament support means on one end of said bulb including metallic current leads and metallic foil means for connecting said metallic current leads to the legs of said tungsten filament, a fill gas mixture in said cavity including an inert gas and a gaseous fluorinated hydrocarbon consisting only of carbon, fluorine and bromine and having a composition of $3.2 \times 10^{-7}$ to $8 \times 10^{-7}$ gram atoms of carbon, $2.1 \times 10^{-6}$ to $5.2 \times 10^{-6}$ gram atoms of bromine and $1.5 \times 10^{-6}$ to $3.8 \times 10^{-6}$ gram atoms of fluorine per cc of cavity volume, said bulb walls, tungsten filament and filament support means having native retained oxygen thereon releasable upon bulb operation to add a further fill gas constituent of free oxygen in the range of $1.3 \times 10^{-6}$ to $3.3 \times 10^{-6}$ gram atoms per cubic centimeter of cavity volume to balance the gram atom constituent of the fill gas in the form of free fluorine released during bulb operation.

2. A method for fabricating a tungsten halogen lamp comprising the steps of forming a glass envelope including a tubulation on one end thereof and an open end on the opposite end thereof, preforming a tungsten filament and mount assembly including a filament component having two legs joined to current leads by means of lenticular molybdenum foil members to form a tungsten filament and lead set, locating the current leads, foil components and filament through the open end of the envelope on a lead set mount having a tapered surface thereon facing in the open direction of the envelope, directing a cover gas through the envelope of the tubulation thereon through the open end thereof and across the tapered surface of the lead set mount to maintain a smooth gas flow across the filament lead set, thereafter heating and hermetically press sealing the envelope to the molybdenum foils to produce a hermetic seal of the envelope with respect to the foil to retain a quantity of native oxygen on the lead set releasable upon bulb operation to add a fill gas constituent of free oxygen in the range of $1.3 \times 10^{-6}$ to $3.3 \times 10^{-6}$ gram atoms per cubic centimeter of a final cavity volume, evacuating the bulb through the tubulation to approximately $1 \times 10^{-5}$ torr and thereafter filling the bulb with inert gas of 99.995% purity and a concentration of a gaseous fluorinated hydrocarbon consisting only of carbon, fluorine and bromine having quantities in the range of $3.2 \times 10^{-7}$ to $8 \times 10^{-7}$ gram atoms of carbon, $2.1 \times 10^{-6}$ to $5.2 \times 10^{-6}$ gram atoms of bromine and $1.5 \times 10^{-6}$ to $3.8 \times 10^{-6}$ gram atoms of fluorine (all per cubic centimeter of the total cavity volume), and thereafter sealing the tubulation.

* * * * *